United States Patent [19]

Wiendahl et al.

[11] 4,102,351

[45] Jul. 25, 1978

[54] SPRAYING DEVICE FOR USE IN A BOTTLE CLEANING MACHINE

[75] Inventors: Joachim Wiendahl, Dortmund; Klaus Jendrichowski, Holzwickede; Wolfgang Süshradt, Dortmund, all of Germany

[73] Assignee: Holstein und Kappert Aktiengesellschaft, Dortmund, Germany

[21] Appl. No.: 767,315

[22] Filed: Feb. 10, 1977

[30] Foreign Application Priority Data

Feb. 21, 1976 [DE] Fed. Rep. of Germany ..... 2607077

[51] Int. Cl.[2] ..... B08B 3/02; B67C 1/00

[52] U.S. Cl. ..... 134/129; 134/131; 134/152; 134/180

[58] Field of Search ..... 134/43, 72–73, 134/129, 131, 152, 167 R–168 R, 180

[56] References Cited

U.S. PATENT DOCUMENTS

| | | | |
|---|---|---|---|
| 3,225,776 | 12/1965 | Plock et al. | 134/129 |
| 3,561,459 | 2/1971 | Ciongwa et al. | 134/129 X |

FOREIGN PATENT DOCUMENTS

| | | | |
|---|---|---|---|
| 734,639 | 10/1932 | France | 134/129 |
| 2,152,429 | 4/1973 | Fed. Rep. of Germany | 134/167 R |
| 32,072 | 2/1934 | Netherlands | 134/129 |

*Primary Examiner*—Robert L. Bleutge

*Attorney, Agent, or Firm*—Toren, McGeady and Stanger

[57] ABSTRACT

A spraying device for use in a bottle cleaning machine is disclosed having a conveyor chain which is movable through the cleaning machine. A plurality of bottle receiving receptacles are supported from the chain and the bottles to be cleaned are carried in the receptacles. A plurality of spray tubes having a nozzle for directing the spray in a fixed direction with respect to the tube are mounted for pivotal movement so that the spray from each tube is directed through a predetermined spraying zone into a bottle as the conveyor chain moves through the cleaning machine and as the spray tubes are pivoted through a spraying zone. The spray tubes are aligned in series so that the spray from each tube is directed into one of the bottles and so that the axes of the sprays from the different tubes are parallel, and coupling means connect each of the spray tubes with each other so that they pivot through the zone together. A driving pin is carried by each of the bottles and a driver arm is carried by at least one of the spray tubes so that the arm is engaged by the driving pin at a starting position of the spraying zone and as the bottles move through the spraying zone the driving pin continues to engage the driver arm thus causing pivotal movement of each of the spray tubes through a predetermined angle defining the spraying zone. Means are connected with the tubes for returning them to the starting position when the driving pin and driver arm become disengaged at the end position of the spraying zone.

5 Claims, 5 Drawing Figures

SPRAYING DEVICE FOR USE IN A BOTTLE CLEANING MACHINE

BACKGROUND OF THE INVENTION

The invention relates generally to bottle cleaning machines and more specifically to a spraying device for use in such bottle cleaning machines. The spraying device of the present invention is of the type which includes a conveyor chain which operates either continuously or intermittently through the device and which carries bottle receiving receptacles for supporting therein the bottles to be cleaned in the machine. Further, the device is of the type including one or more spray tubes mounted for pivotal movement through a predetermined spraying zone from a starting position to an end position and then to be returned to the starting position.

Previously known bottle cleaning machines have been equipped with fixed spray tubes. The bottle receiving receptacle (sometimes referred to as "a cell") carried bottles therein in a position with their open mouth held downwardly, and had to be advanced intermittently in order to receive sufficient spray during the spraying cycle for cleaning. Such prior operations, however, required that the bottles carried in their respective bottle receiving receptacles had to constantly be accelerated and decelerated in the direction of movement, thus requiring a great deal of driving power which was needed to overcome large inertial forces.

In order to avoid this disadvantage and to provide a sufficient amount of spray for cleaning, the conveyor chains carrying the bottle receiving receptacles were made to be continuously advanced and the spray tubes were arranged to move with the chain and be retarded for a certain period of time and then be returned to a starting position. This was accomplished by providing that the spray tubes were secured in a rack suspended for swinging movement and which could be moved through a predetermined spraying path from a starting position to an end position and then back again to the starting position. Pivotal drivers were arranged on one or both sides of the rack panel and protruded into the path of travel of the chain so as to be engaged by the studs of the chain when in the starting position in order to impart a driving force to the rack so as to cause the rack to be advanced through the spraying zone. The pivotal drivers were then disengaged from the studs of the chain at the end position of the zone completing the spraying operation.

This type of device also required that considerable masses be moved back and forth through the zones within a relatively short period of time thus resulting in various elements such as the chain studs and the drivers of the rack engaging each other a considerable number of times thus being subjected to considerable wear. Additionally, as a result of the suspension of the rack for swinging movement, the rack was caused to describe a circular path so that the central position of the spray nozzles was not maintained and as a result the spray emanating from the nozzle was not efficiently utilized. As a result, the spray jet from the nozzle was caused to strike the supporting surfaces of the bottle receiving receptacles and at the mouth of the bottles so that effective spraying action was lost, particularly at the starting and the end positions of the spraying zone.

A further disadvantage of the foregoing types of devices is that the alignment of the spray with the bottles to be sprayed was a function of and relied upon the positioning of the chain studs of the conveyor chains. This resulted in inaccurate alignment since there was no guarantee of proper spraying alignment when the conveyor chain was extended or if the bottle receiving receptacles were improperly inserted in the chain. This was particularly true since the rack described above carried several spray tubes and the possible different positions of the various bottle cleaning receptacles could not be taken into consideration (see DOS 21 52 429).

It is accordingly an object of the present invention to provide a substantially simplified type of spraying device while avoiding the foregoing disadvantages of the prior art.

A more specific object of the present invention is to reduce the masses which are necessarily required by the use of a rack of the type described above and to provide the possibility of proper alignment which insures an exact correlation of the spray jet and the bottle mouth.

A further object of the present invention is to provide means to guide the spray jet into the bottle mouth in such a way that it covers the entire cross-sectional area of the bottle in the feeding direction of the bottle receiving receptacle so as to avoid inaccuracies caused by turning spray tubes in a circular path.

SUMMARY OF THE INVENTION

The foregoing objects are generally accomplished by providing a spraying device for use in a bottle cleaning machine having a conveyor chain movable through the cleaning machine with a plurality of bottle receiving receptacles supported on the chain for carrying therein the bottles to be cleaned, with a plurality of spray tubes for directing a spray toward the open mouths of the bottles and mounted only for pivotal movement about an axis of rotation so as to direct the spray therefrom through a predetermined spraying zone into the bottle as the bottle is moved along the path of the conveyor, but in which the spray tubes are not movable along a path parallel to the movement of the chain. The spray tubes are arranged in series in the direction of movement of the chain and a coupling means connects each of the plurality of spray tubes with each other so that they will be caused to pivot through the predetermined angle together. A driving pin is carried by each of the bottle receiving receptacles and a driver arm is carried on at least one of the spray tubes to be engaged by a driving pin so as to cause movement of each of the spray tubes through the predetermined angle from a starting position to an end position thus defining a spraying zone. Means are also connected with the tubes for pivotally returning the spray tubes to the starting position of the spraying zone.

By providing a spraying device in accordance with the present invention, the foregoing described disadvantages of the known devices are avoided. Due to the stationary arrangement of each spray tube and the pivotal movement of the spray tubes through a predetermined angular range, the objectionable large masses are considerably reduced and at the same time proper alignment of the spray with a particular bottle to be cleaned is insured. Further, because of the angular range of spray as a result of the pivotal movement of the spray tubes, the spray can more efficiently cover the bottle at least in one cross-sectional plane, resulting in a more complete entry of the spray into the bottle cavity from different angular positions causing reflection of the spray off the walls of the bottle. This substantially increases the effectiveness of spraying the inner portions of the bottle.

A further feature of the invention provides that the longitudinal axis of the driving pins extend in a direction perpendicular to the longitudinal axis of the bottle receiving receptacles and lies on a plane with the end faces of the bottles which are carried in the bottle receiving receptacles.

In one embodiment of the return device, a return spring is connected by a lever to the couplings connecting the various spray tubes so as to cause the spray tubes to pivot through the predetermined angle in a direction returning the spray tubes to the starting position of the spraying zone. In a further embodiment of the return device, a rocker arm is mounted for pivotal movement toward and away from the conveyor chain and carries a cam member having a cam surface engageable by a cam engaging means on the chain conveyor when the cam moves into the path of travel of the conveyor thus causing the rocker arm to be moved away from the chain, and linkage elements connect the rocker arm with at least one of the spray tubes to cause movement of the rocker arm toward the chain when the spray tubes pivotally move from the starting position to the end position of the spraying zone, and so that when the driving pin and the driver arm become disengaged at the end of the spraying zone the cam will be in the path of travel of the chain so as to be engaged by the engaging means of the chain to cause movement of the rocker arm away from the chain and to cause the spraying tubes to be moved by the linkage arm through the predetermined angle in a direction returning the spray tubes to the starting position.

A simplified means of supply of spray fluid to the tubes is obtained by arranging the spray tube at least on one side in a spray tube box which has a feed for spray fluid connected thereto.

As a result of the unit construction of the spray tubes according to the present invention, as well as to the articulation directly on the bottle receiving receptacles, and considering the longitudinal axis of the bottles within the receptacles, division error as had occurred in the prior art known devices, do not lead to misalignment of the spray. Additionally, the articulation of the spray according to the present invention has the advantage that the entire spray tube group can be arranged at any point in the machine, independent of the division of the respective conveyor chain. Also, as a result of mounting the spray tubes for pivotal movement no back and forth movement of the tubes is required, rather only pivotal movement is required, thus forming a significant advantage over the art. Such pivotal movement also results in a greater period of time available to effect return of the spray tubes to the starting position of the spraying zone.

BRIEF DESCRIPTION OF THE DRAWINGS

The invention will be described more fully hereinafter in connection with the accompanying drawings in which.

DESCRIPTION OF THE INVENTION

Figure 1:
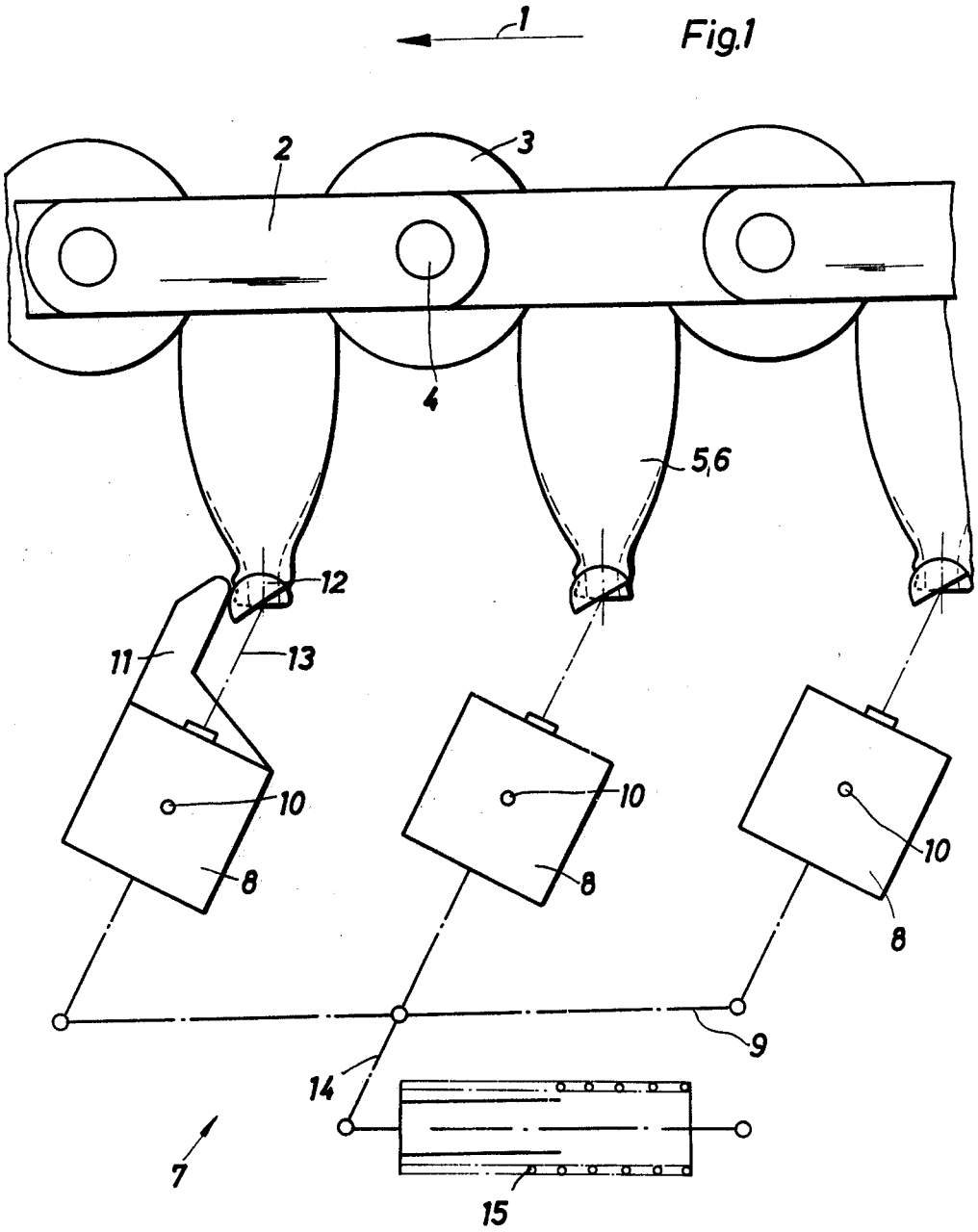
FIG. 1 is a side elevational view showing the spraying device of the present invention in which the various spraying tubes are oriented with their sprays directed in the starting position of the spraying zone, and showing one type of return device.

Referring now in more detail to the accompanying drawings, FIG. 1 shows the various elements of the spraying device of the present invention within a bottle cleaning machine having a conveyor travelling through the machine in a direction indicated by arrow 1.

The conveyor preferably operates continuously through the cleaning machine and includes a rotating conveyor chain comprising side bars 2 and rollers 3 which are connected with each other by chain studs 4. The rollers 3 are supported on and run on supporting rails, not shown herein as they form no part of the present invention. A plurality of bottle receiving receptacles 5, for receiving and supporting therein bottles 6, which are to be cleaned by the spraying device, are connected to the conveyor chain at opposite ends, and in the embodiment shown herein are supported in such a manner that they extend in a downward direction from the conveyor chain. As the conveyor chain moves in the direction of arrow 1, the bottles 6 supported in the receptacles 5 will be moved through a spraying zone of the spraying device. The spraying zone has a starting position and an end position to be described more fully hereinafter.

A plurality of spray tubes 8 having one or more spray nozzles, or alternatively a plurality of individual spray tubes with a single spray nozzle, are arranged in one or more spray tube groups 7 in a position beneath the path of travel of the receptacles 5 which are carried on the conveyor chain. Connected with the various spray tubes is a source of fluid to be sprayed into the various bottles carried in the receptacles 5 for cleaning purposes. The individual spray tubes may be elongated having a longitudinal axis 10. Each of the spray tubes 8 is mounted for pivotal movement about its respective longitudinal axis 10. The various spray tubes of the group are connected with each other through coupling elements 9 so as to be grouped together for simultaneous and corresponding movement about their respective longitudinal axes. Accordingly, upon pivotal movement of one of the tubes of the group, each of the other spray tubes will be caused to be pivoted about its respective axis together at the same rate of movement and through the same angle of displacement as each of the other spray tubes of the group. In this manner, the spray from each spray tube will be continuously directed in a path parallel to the spray of each of the other tubes. The spray tubes are mounted in such a manner so that they are not movable in the same direction of movement indicated by arrow 1 nor in a reverse direction. In other words, each of the spray tubes is stationary except for its ability to be pivotally moved about its axis.

A driving pin 12 is carried on a distal end of each of the bottle receiving receptacles 5. A driver arm 11 is carried by at least one of the spray tubes 8 of each group 7 and extends in a direction toward the conveyor chain into the path of travel of the receptacles so as to be intercepted and engaged by one of the driving pins. The point of engagement of one of the driving pins 12 with an end of the driver arm 11, as the conveyor chain moves through the cleaning machine, will define a starting position of the spraying zone at which point the spray jet emanating from the nozzles of the various tubes will first enter a bottle carried in a receptacle to commence the spray cleaning of the various bottles. As the conveyor continues to move in the direction of arrow 1 the driving pin will continue to be engaged with the arm 11 thereby pushing against the distal end of the arm 11 and causing the spray tube connected to the arm to be pivoted about its axis 10. As a result of the couplings 9 connecting the various spray tubes, each of the other spray tubes will also be pivoted about its axis 10. In this manner, the spray from the various tubes is continuously directed into the bottle at different angles as the bottles move through the spraying zone. When the driving pin rides off the end of the arm 11 (which is shaped in a manner to facilitate this operation) the end position of the spraying zone will have been reached and the spray from the various tubes will at this time be directed into the bottles from an angle opposite to that of the starting position.

Figure 3:
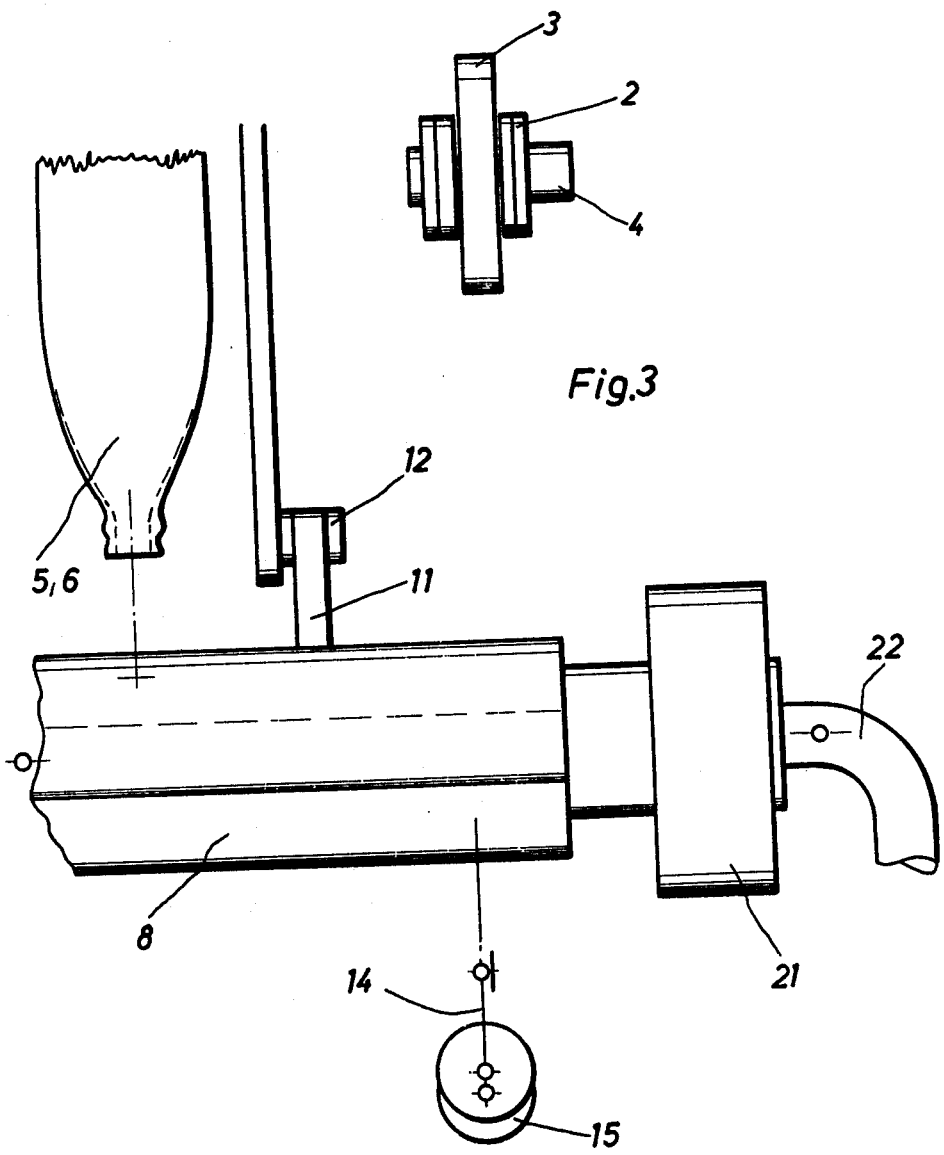
FIG. 3 is an end elevational view of the spraying device shown in FIGS. 1 and 2.

As will be noted from FIG. 3, the longitudinal axis of the driving pin extends in a direction perpendicular to the longitudinal axis of the various bottle receiving receptacles and is also arranged so that it lies in a plane which passes through the open end face of one of the bottles 6 when such a bottle is supported in one of the receptacles 5. As can be appreciated from the various views, the driving pins have a curved surface the radius of which corresponds to the distance that the stop face of the driver 11 (i.e. that surface engaged by the driving pin) is offset from the axis 13 of the spray jet emanating from the nozzle of the spray tube.

Figure 2:
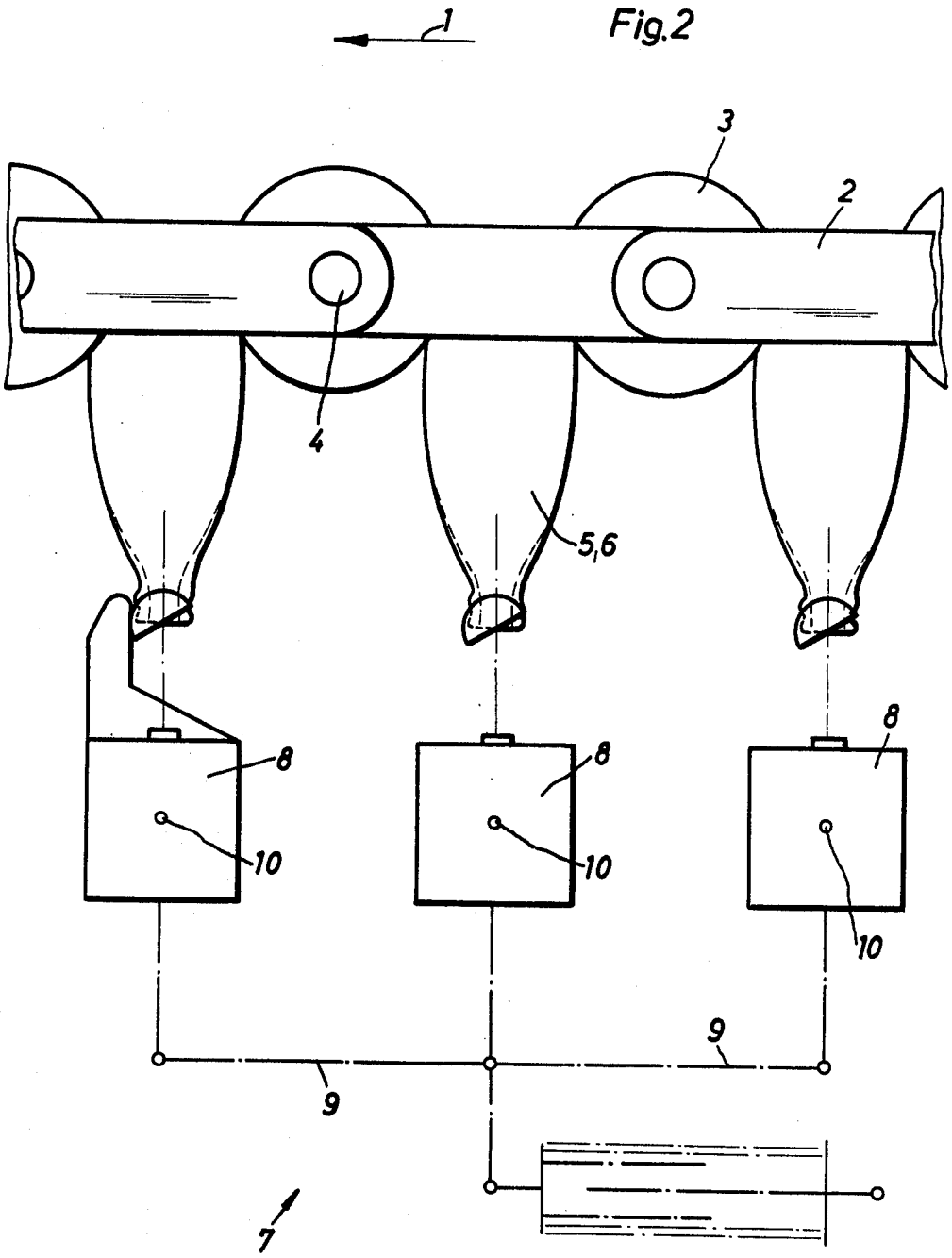
FIG. 2 is a view similar to that of FIG. 1 showing the spray tubes oriented in a central position in said spray zone.

Upon reaching the end position of the spray zone, at which time the driving pin 12 becomes disengaged and rides off the end of the driver arm 11, the bottles will continue to move in the direction of arrow 1 passing beyond the range of the spray zone at which time a return device connected with the various spray tubes will cause the spray tubes to again pivot about their longitudinal axis 10, but this time in a direction opposite to the direction in which they were caused to pivot as a result of the driver arm 11 being engaged by the pin 12, so as to be caused to return to the starting position in order to start spraying a next series of bottles. The return device associated with the spray tube group shown in FIGS. 1, 2 and 3 includes a return spring 15 acting through a two-arm lever 14 and may be connected to the coupling 9. During the pivotal movement of the spray tubes from the starting to the end positions of the spray zone, the return spring may be placed either under tension or compression so that at the end of the spraying zone, it will operate through the two-arm lever to act on the coupling to return the spray tubes to the starting position.

Figure 4:
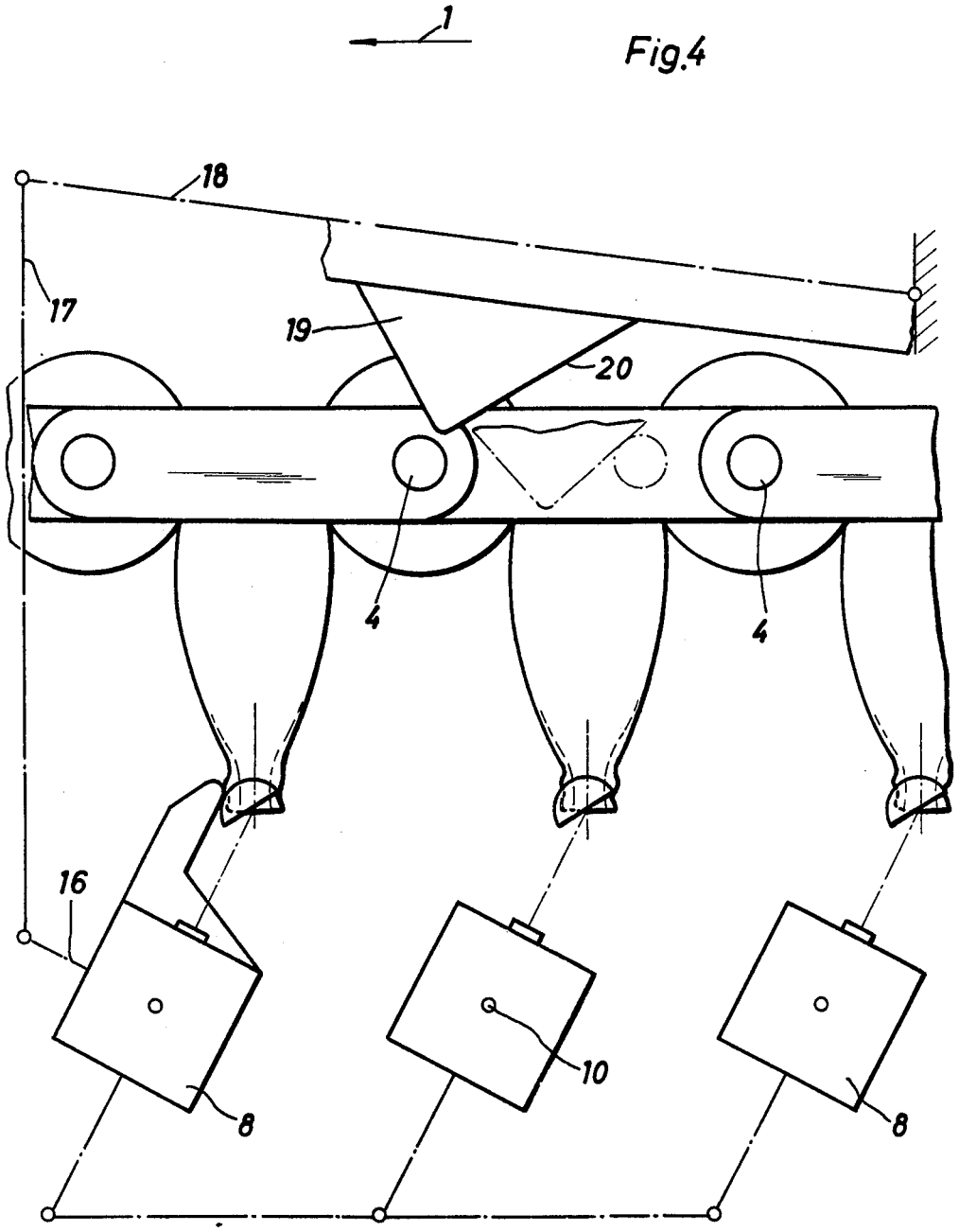
FIG. 4 is a side elevational view of the spraying device showing the various tubes oriented in a position at the starting position of the spraying zone and showing another type of mechanical return device.

An alternative form of return device is shown in FIG. 4. This embodiment includes a rocker arm 18 mounted for pivotal movement above the conveyor chain for movement toward and away from the conveyor chain. The rocker arm 18 carries a wedge-shaped cam member 19 having a cam face 20. Linkage elements including a coupling element 17 connected at one end thereof to the rocker arm 18, and a lever 16 connecting the other end of the coupling element 17 with one of the spray tubes 8, is provided to operatively link the various spray tubes of a group with the rocker arm 18. When a driving pin of one of the receptacles 5 engages the stopface of the driver arm 11 so that continued movement of the conveyor causes pivotal movement of the tubes 8 through the spraying zone, the rocker arm 18 will be caused to pivot in a direction toward the conveyor chain as a result of the linkages with the spray tubes. At the end position of the spraying zone the rocker arm 18 will be in its fully lowered position so that the cam member 19 will be in the position shown in dot-dash lines of FIG. 4 and will thus lie in the path of travel of the conveyor chain. At this point, one of the chain studs 4 will engage the cam surface 20 of the cam member 19 causing the cam surface 20 to ride thereon so that the rocker arm 18 is pivotally moved away from the conveyor chain, thus causing the spray tubes 8 to be returned to the starting position of the spraying zone. This starting position will be reached when the cam surface 20 rides off the chain stud 4 so that the cam 19 is now out of the path of travel of the conveyor chain. The spray tubes will now be at the starting position once again so that the spray from each tube will be directed at a bottle 6 carried in one of the receptacles 5.

FIG. 3 shows a spray tube box 21 having a feed line 22 to provide a supply of spray fluid. Several spray tubes may be mounted at least on one side in the spray tube box 21.

Figure 5:
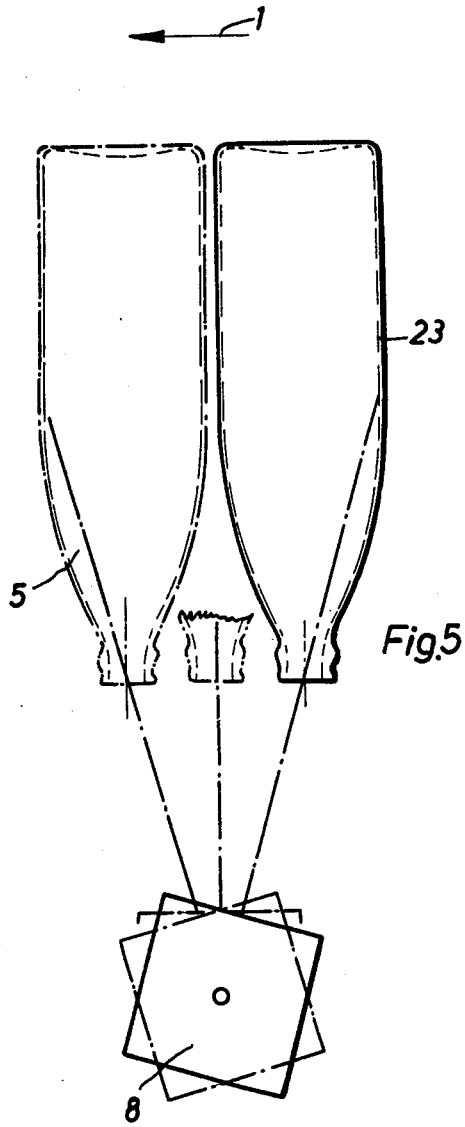
FIG. 5 is a schematic illustration of a spraying tube indicating the various directions of the spray jets therefrom and the angular range of said spray jets.

In operation, bottles to be cleaned are placed within the bottle receiving receptacles 5 which are supported on the conveyor chain and caused to move through the spraying device in the bottle cleaning machine, according to the present invention. As the bottles move in the direction of arrow 1 through the spraying device, a driving pin 12 will be caused to move toward the stopface of a driver arm 11 and upon engagement therewith will cause the driver arm 11 to move in a direction corresponding to that of arrow 1 of the conveyor chain. The point of contact of the driving pin 12 with the driver arm 11 is determined by the layout and positioning of the driver arm 11. It is intended, however, that at the point of contact the spray from an individual spray tube will first enter the bottle at an angle so that the spray will first strike the bottle at a rear wall thereof, thus defining the starting position of the spraying zone. As the conveyor chain continues to move through the spraying device and the receptacle having the pin engaged with the driver arm 11 causes the spray tubes to pivot about the longitudinal axis 10 (in a counterclockwise direction as viewed in the drawings) the spray will continue to be directed at the open mouth of the bottle as shown in FIG. 5, so that the spray will cover the entire cross-sectional plane of the bottle 6 as the bottle moves through the spraying zone. At the end position of the spraying zone the jet of the spray tube will enter the bottle at an angle so as to strike the front wall (with respect to the direction of movement of the bottle). After the bottle carried in its respective receptacle has passed through the predetermined spraying zone, the driving pin 12 will ride off the driver arm 11 to allow the return device (according to the embodiment shown in either FIGS. 1 or 4) to cause the spray tubes to pivot in a clockwise direction as viewed in the drawings so that the spray will again be at a starting position of the spray zone.

While the invention has been described and illustrated with respect to embodiments which produce satisfactory results, it will be understood, after appreciating the purposes of the invention, that various other changes and modifications may be made without departing from the spirit and scope of the invention, and it is therefore intended to cover all such changes and modifications in the claims.

What is claimed is:

1. A spraying device for use in a bottle cleaning machine, comprising a conveyor chain movable through said cleaning machine, a plurality of bottle receiving receptacles supported on said conveyor chain for carrying therein bottles to be cleaned, a plurality of spray tubes for directing a spray in a predetermined and fixed direction with respect to said spray tubes and mounted for pivotal movement only through a predetermined angle of displacement about an axis of rotation for directing the spray therefrom through a predetermined spraying zone into a bottle carried in said bottle receiving receptacles as said conveyor chain moves through said cleaning machine, said spray tubes being arranged in series with respect to the direction of movement of said conveyor chain so that each spray tube is oriented to direct its spray through said angle of displacement into one of said bottles as said bottles move through said spraying zone, coupling means connecting each of said plurality of spray tubes with each other to cause each spray tube to be pivoted about its axis of rotation together with each other spray tube of said plurality through the same angle of displacement, a driving pin carried by each of said bottle receiving receptacles, a driver arm carried by at least one of said spray tubes to be engaged by a driving pin of one of said receptacles for causing pivotal movement of each of said spray tubes through said predetermined angle from a starting position to an end position defining said spraying zone without causing longitudinal displacement of said spray tubes in the direction of said conveyor, said driving pin engaging said driver arm at the starting position of said spraying zone and being disengaged therefrom at said end position as said conveyor chain moves through said cleaning machine, and means connected with said spray tubes for pivotally returning said spray tubes to said starting position when said spray tubes have reached said end position of said spraying zone.

2. The spraying device according to claim 1 wherein said driving pin has its longitudinal axis extending in a direction perpendicular to the longitudinal axis of said bottle receiving receptacle and is positioned so that it lies in a plane of the open end face of a bottle when said bottle is carried in said receptacle.

3. The spraying device according to claim 1 wherein said means for returning said spray tubes to said starting position comprises a return spring and a lever connecting said return spring to said coupling means so that when said driving pin and said driver arm become disengaged at said end position of said spraying zone, said return spring will cause said spray tubes to pivot through said predetermined angle in a direction returning said spray tubes to said starting position.

4. The spraying device according to claim 1 wherein said means for returning said spray tubes to said starting position comprises a rocker arm mounted for pivotal movement toward and away from said conveyor chain, a cam member carried by said rocker arm and having a cam surface engageable by cam engaging means carried on said chain when said cam moves into the path of travel of said chain to cause movement of said rocker arm away from said chain, and linkage elements connecting said rocker arm with at least one of said spray tubes to cause movement of said rocker arm toward said chain as said spray tubes pivotally move from the starting position to the end portion of said spray zone, so that when said driving pin and said driver arm become disengaged at said end position of said spray zone, said cam will be in the path of travel of said chain and said cam engaging means will engage said cam surface to cause movement of said rocker arm away from said chain and to cause said spray tubes to be moved by said linkage arm through said predetermined angle in a direction returning said spray tubes to said starting position.

5. The spraying device according to claim 1 wherein said spray tubes are mounted on at least one side of a spray tube box, and further comprising a fluid feed line connected to said spray tube box for supplying fluid to be sprayed to said spray tubes.

* * * * *